US006619367B1

(12) United States Patent
Kawakita

(10) Patent No.: US 6,619,367 B1
(45) Date of Patent: Sep. 16, 2003

(54) PEEPING TOM DETERRENT DEVICE FOR HORIZONTAL WINDOW BLINDS

(76) Inventor: Kevin Kawakita, 5812 Temple City, BL. PMB 100, Temple City, CA (US) 91780

( * ) Notice: Subject to any disclaimer, the term of this patent is extended or adjusted under 35 U.S.C. 154(b) by 591 days.

(21) Appl. No.: 09/648,602

(22) Filed: Aug. 26, 2000

(51) Int. Cl.[7] ..... E06B 9/38
(52) U.S. Cl. ..... 160/178.1 R; 160/172 R
(58) Field of Search ..... 160/178.1 R, 178.3 R, 160/172 R, 176.1 R, 173 R, 168.1 R, 107

(56) References Cited

U.S. PATENT DOCUMENTS 2,153,893 A 4/1939 Johanson
2,205,156 A 6/1940 Rowley
4,226,455 A 10/1980 Hennequin
4,341,254 A * 7/1982 Schaller et al. ..... 160/172 R
5,282,514 A 2/1994 Felcetto
5,597,027 A * 1/1997 Simon et al. ..... 160/178.3 R

* cited by examiner

*Primary Examiner*—David M. Purol

(57) ABSTRACT

FIG. 4 is a close perspective view of a clip (11) in position for attachment to a slat (24), with the slat cover strip (40) already threaded through both loops (26, 38) on the clip (11). The position of the control cord hole (48) relative to the slat cover strip (40) is particularly clear from this view. The slot's (32, 28) position relative to the vertical control cord (30) is also shown. The vertical control cord (30) must pass through the slot (32, 28) as the clip (11) is being positioned about the slat (24) for fastening. This view makes it clear that the slat cover strip (40) will be moved into position proximate the vertical control cord hole (30) when the slat (24) is tilted. The two loops (38, 26) on the clip (11) cause one portion of the slat cover strip (40) to block the vertical control cord hole (30) from the front, while the other portion of the slat cover strip (40) blocks the vertical control cord hole (30) from the rear. This maximizes the obstruction of the peeping Tom's (100) view.

20 Claims, 6 Drawing Sheets

PEEPING TOM DETERRENT DEVICE FOR HORIZONTAL WINDOW BLINDS

BACKGROUND OF THE INVENTION

1. Field of the Invention

Figure 1:
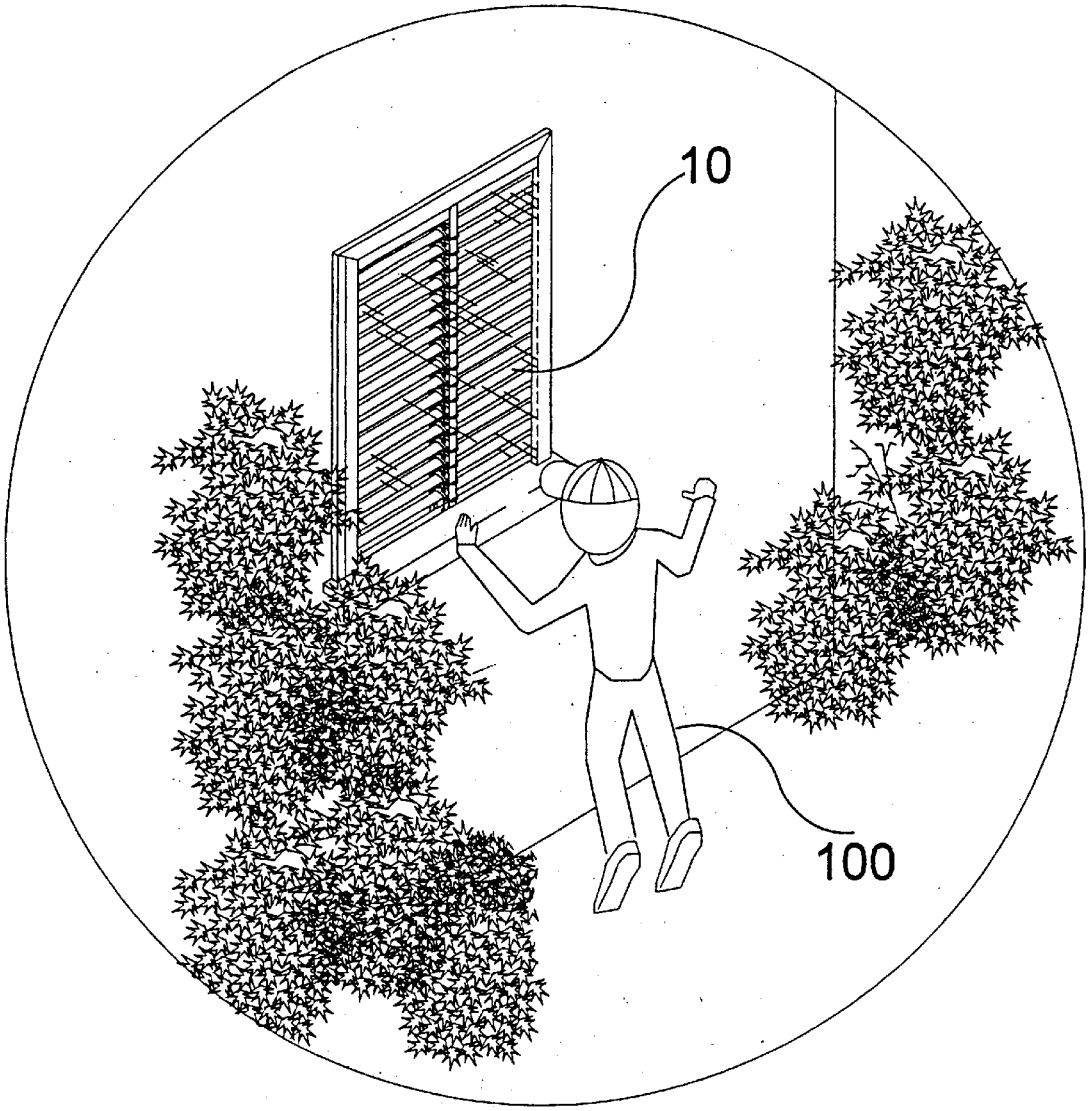

The present invention relates generally to window coverings, and more specifically, to window blinds of the type having slats, control cords, and control cord holes in the slats. These types of window blinds usually allow a peeping Tom to peer through the control cord holes even when the blinds are fully closed. The problem is compounded when the window blinds are recessed within a window casing, creating gaps along the sides between the ends of slats and the window casing sides.

2. Description of the Prior Art

There are various devices designed enhancing the general performance of window blinds having slats, such as venetian blinds. These included vertical, cloth cord hole covering strips and horizontal, cloth cord hole slat strips, which were sewn together in the form of a ladder when, viewed from the side of the blind. These strips were installed at the factory, were not removable, and could not be retroactively added to existing window blinds.

Typical of other devices is U.S. Pat. No. 5,282,514 issued to Roy Felcetto on Feb. 1, 1994.

Another patent was issued to Petrus Hennequin on Oct. 7, 1980 as U.S. Pat. No. 4,226,455. Yet another U.S. Pat. No. 2,205,156 was issued to W. A. Rowley on Jun. 18, 1940 and still yet another was issued on Apr. 11, 1939 to E. Johanson as U.S. Pat. No. 2,153,893.

Hunter Douglas (R) has new (1999) miniblinds in the prior art. These miniblinds have a slat tilt axis off-center width on the horizontal slat allowing the slat center hole to be made much smaller for deterring Peeping Toms. In viewing the cord mechanism from the side which looks like a rope ladder, the slat tilt axis is located close to the rear vertical control cord and not the center width of the slat. The rear vertical control cord is mostly stationary during a tilt operation with the front vertical control cord shifting position up and down. This improvement is only available on newly manufactured blinds. This design is in the public domain and is used by several current blind manufacturers.

U.S. Pat. No. 5,282,514

Inventor: Roy P. Felcetto

Issued: Feb. 1, 1994

A window guard for a Venetian blind hung window consisting of oppositely disposed sleeves, the sleeves being adapted to be affixed to opposite ends of a window frame, each sleeve containing a rotator extending substantially the length of the sleeve to form an assemblage, each sleeve and rotator being slotted along their lengths, said slots permitting the slats of a venetian blind to extend within the assemblages and move reciprocally and pivotally therein, each rotator having a series of equally spaced extensions which, upon selective rotation of the rotator, prevents reciprocated and/or pivotable movement of the blind.

U.S. Pat. No. 4,226,455

Inventor: Petrus J. Hennequin

Issued: Oct. 7, 1980

This invention relates to a locking device for a raisable or liftable venetian blind in which the bottom rail of the venetian blind includes an end piece extending into and guided by the side housing of the blind and in which a flexible lifting member engages the end piece of the bottom rail to raise and lower the same. A spring urged pivoted latch is provided within the lower portion of the housing which automatically engages over the end piece of the bottom rail when it is in the lowered position and the tension in the lifting member is relaxed. Thus the blind is locked in the down position. When tension is applied to the lifting member to lift the blind, the lifting member moves the latch out of locking engagement with the end piece permitting the blind to be raised.

U.S. Pat. No. 2,205,156

Inventor : W. A. Rowley

Issued: Jun. 18, 1940

This invention provided securing means whereby blinds could be made substantially burglarproof. A blind's construction is provided wherein latch means are employed for securing the slats of the blinds in a fixed position against being raised or lowered.

U.S. Pat. No. 2,153,893

Inventor: E. Johanson

Issued: Nov. 19, 1938

This invention relates to clamps and provides a clamp which is especially designed for use in connection with a Venetian blind and serves releasably to hold a plurality or group of the slats of the blind against tilting during cleaning or dusting thereof.

While these devices may be suitable for the purposes for which they were designed, they would not be suitable for the purposes of the present invention, as hereinafter described.

Therefore, it is believed that a need exists for a vision blocking device for use on window blinds, which is unobvious, economical, removable, and retroactively installable on modern window blinds.

SUMMARY OF THE PRESENT INVENTION

Objects and Advantages

A primary object of the present invention is to overcome the shortcomings of the prior art.

Another object of the present invention is to provide a device that prevents peeping Toms from gazing through the control cord holes in the slats of typical window blinds. Peeping Toms can currently peer or else video tape with telephoto lenses through the cord holes and through the edge gaps of fully closed miniblinds. For profit World Wide Web sites have been set up showing pictures of partially undressed and fully undressed unsuspecting females who have been candidly and without expressed consent been videotaped by such peeping Toms. The full video identities of these women who are people's wives, mother's and daughters are shown to a worldwide audience. Many of these sites are out of US jurisdiction, so, there is no way to legally stop this activity. The best option is to stop the activity at its source.

Yet another object of the present invention is to provide such a device that is simple to install on existing window blind installations, without the use of special tools or expertise.

Still another object of the present invention is to provide such a device that is inexpensive.

Still yet another object of the present invention is to provide such a device which includes a slat cover strip and edge cover strip which can be of whatever color or pattern is necessary to properly blend with the existing window blinds and the room interior.

Another object of the present invention is to allow the clip to be of different colors to match the window blind color.

Another object of the present invention is to provide a decorator item where the slat cover strips and edge cover strips can serve to accent the solid blind color, the slat and edge cover strips can have cartoon characters to decorate children's bedrooms, the slat and edge cover strips can have a person's name or family crest, and other decorative or accent uses.

Another object of the present invention is to provide such a device that allows the slat and edge cover strip to be easily removed for cleaning or altering colors of the slat and edge cover strip.

Yet another object of the present invention is to provide such a device that is easily removable in its entirety for addition to another window blind or to change colors or patterns.

Still another object of the present invention is to provide such a device that does not interfere in any way with the tilt closing, tilt opening, raising or lowering of the blinds.

Another object of the present invention is to provide a device that prevents peeping Toms from gazing through the gaps created at the ends of the window blinds in those installations where the window blinds are recessed within a window casing.

Yet another object of the present invention is to provide a device that detachably fastens about a window blind slat, and provides one or more loops through which a vision block member, such as a slat cover strip, is threaded, such that, when the slat is closed, the slat cover strip is positioned proximate the control cord hole in the slat about which the device is fastened.

Still another object of the present invention is to provide such a device that detachably fastens about the window blind slat in such a manner that the control cords are not crimped or redirected.

Still another object of the present invention is to provide a plurality of such devices which are detachably fastened to a corresponding plurality of window blind slats, such devices being vertically aligned for straight positioning of a slat cover strip in the loops on the devices.

Another object of the present invention is to provide such a plurality of devices in a manner such that a device is detachably fastened to each of the window blind slats.

Another object of the present invention is to provide duplicated sets of such devices which can be used with similar operation for each of the multiple vertical slat cord hole columns across a blind. A small blind will have two sets of slat cord hole columns and a wide blind will have up to five sets of slat cord hole columns.

Yet another object of the present invention is to provide such devices with loops that are shaped to retain the slat cover strip in an untwisted and untangled position.

Yet another object of the present invention is to work with the new "anti-peeping Tom" miniblinds as in the Hunter Douglas (R) design mentioned in prior art. In this case, the invention will use edge cover strips to deter a peeping Tom peering through the edge gaps between the edge of the slats and the window casing which still exist and occur in certain window blind mountings which create this edge gap. These types of window blind mountings are preferred by customers for a more compact installation, an easier installation not requiring a "valence" or top board mounting device, an installation which allows furniture to be placed closer to the window, an installation which keeps the blinds cleaner from dust, an installation which interferes less with accompanying draperies, and an installation which is safer for children's bedrooms where blind cords should be kept away from toddler's cribs.

Additional objects of the present invention will appear as the description proceeds.

The present invention overcomes the shortcomings of the prior art by providing an economical, easily installable, easily removable, and retroactively installable device which positions a decorative, slat cover strip over the control cord holes in window blind slats. The device is detachably fastened about a slat, with a slot on the device allowing such fastening without crimping or redirecting the control cords. At least one loop is provided on the device, which is positioned to receive the slat cover strip and retain it without allowing twisting or tangling of the slat cover strip during ordinary use. The loop is slotted for control cord passage during installation. A second loop is provided through which the slat cover strip is threaded. A plurality of these devices is fastened to a corresponding plurality off slats. Once attached the slat cover strip is threaded through the loops and attached to the top or bottom of the window blinds. Once in place, and when the blind is tilt closed, the slat cover strip is positioned proximate the control cord holes, thus blocking the view of the peeping Tom. Wide blinds with more than one control cord hole per slat require additional slat cover strips and attachments. When the window blind is recessed within a window casing, complementary edge cover strips are provided which, when properly affixed proximate the window casing sides, prevent the peeping Tom from gazing through the gap created between the ends of the window blind slats and the window casing sides.

The foregoing and other objects and advantages will appear from the description to follow. In the description reference is made to the accompanying drawings, which form a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a representation of the peeping Tom problem. The present invention is installed (10), and when the horizontal window blinds (41) are closed, will prevent the peeping Tom (100) from gazing through the control cord holes (48) in the slats.

Figure 2:
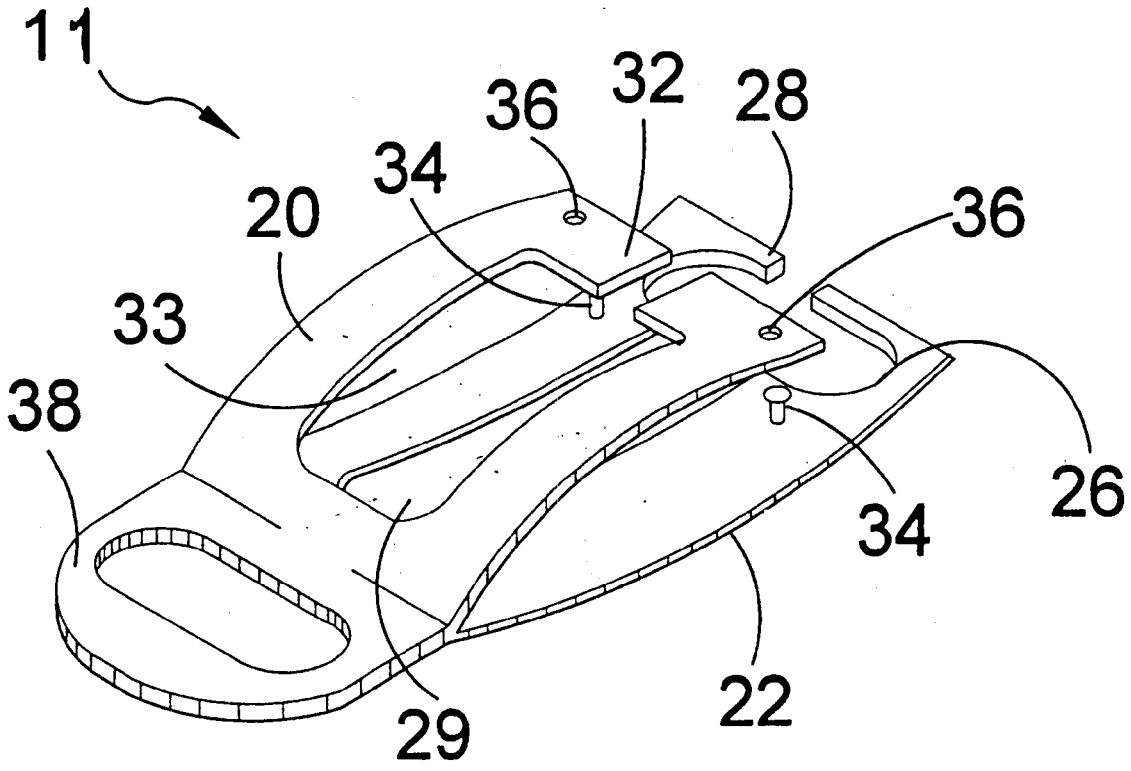

FIG. 2 is a perspective view of the device (10), showing the clip's (11) slotted first (20) and second portions (22), slotted rear loop (26), and attached front loop (38). The first (20) and second portions (22) are shaped for positioning about a window blind slat (24). They can be detachably fastened about the slat (24), with the slots (32, 28) allowing the clip (11) to be moved into position on the slat (24), without disturbing the position or function of the control cords (30, 31).

Figure 3:
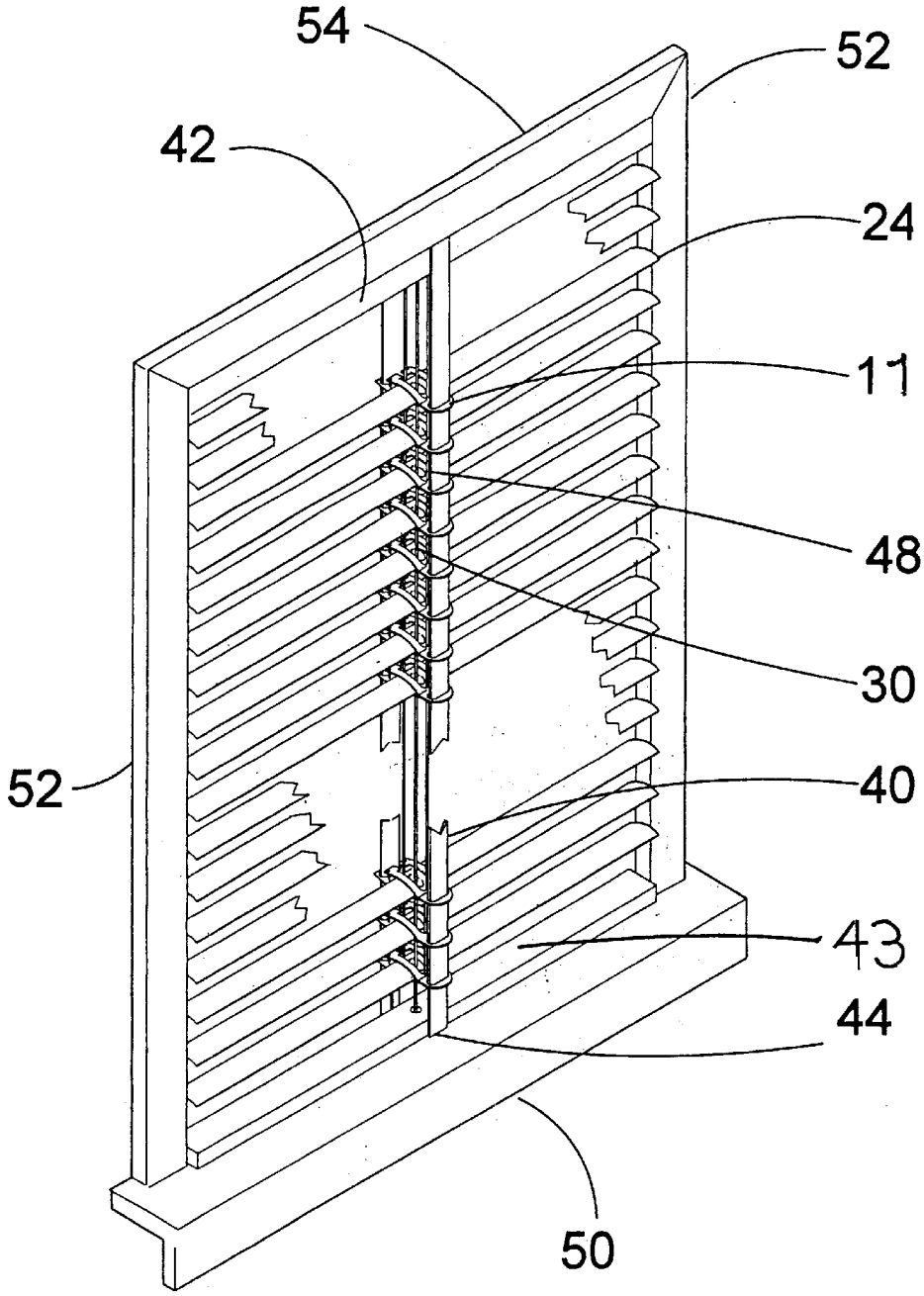

FIG. 3 is a perspective view of a complete installation of the device in which portions are cut away to enable a more complete view of the relationship of the clips (11), slats (24), control cords (30, 31), and slat cover strips (40). In this installation, the owner has chosen a one-to-one correspondence between the clips (11) and all the available slats (24). The blinds are shown in a tilt open position for clarity. During tilt closing the clips (11) tilt with the slats (24) pulling the slat cover strip (40) closer to the almost vertical slat. In such a position the slat cover strip (40) blocks the view through the control cord holes (48).

Figure 4:
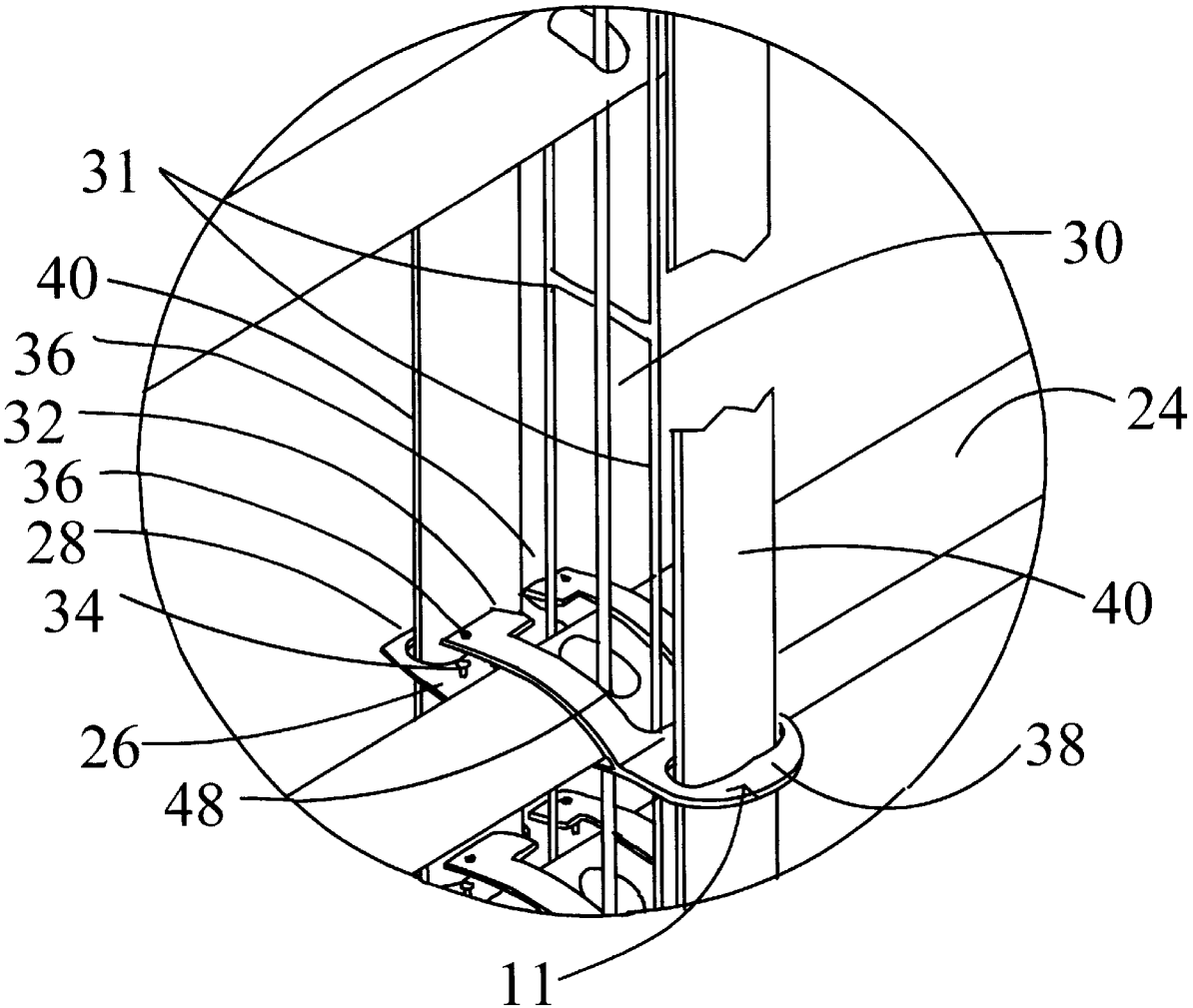

FIG. 4 is a close perspective view of a clip (11) in position for attachment to a slat (24), with the slat cover strip (40) already threaded through both loops (26, 38) on the clip (11). The position of the control cord hole (48) relative to the slat cover strip (40) is particularly clear from this view. The slot's (32, 28) position relative to the vertical control cord (30) is also shown. The vertical control cord (30) must pass through the slot (32, 28) as the clip (11) is being positioned about the slat (24) for fastening. This view makes it clear that the slat cover strip (40) will be moved into position proximate the vertical control cord hole (30) when the slat (24) is tilted. The two loops (38, 26) on the clip (11) cause one portion of the slat cover strip (40) to block the vertical control cord hole (30) from the front, while the other portion of the slat cover strip (40) blocks the vertical control cord hole (30) from the rear. This maximizes the obstruction of the peeping Tom's (100) view.

Figure 5:
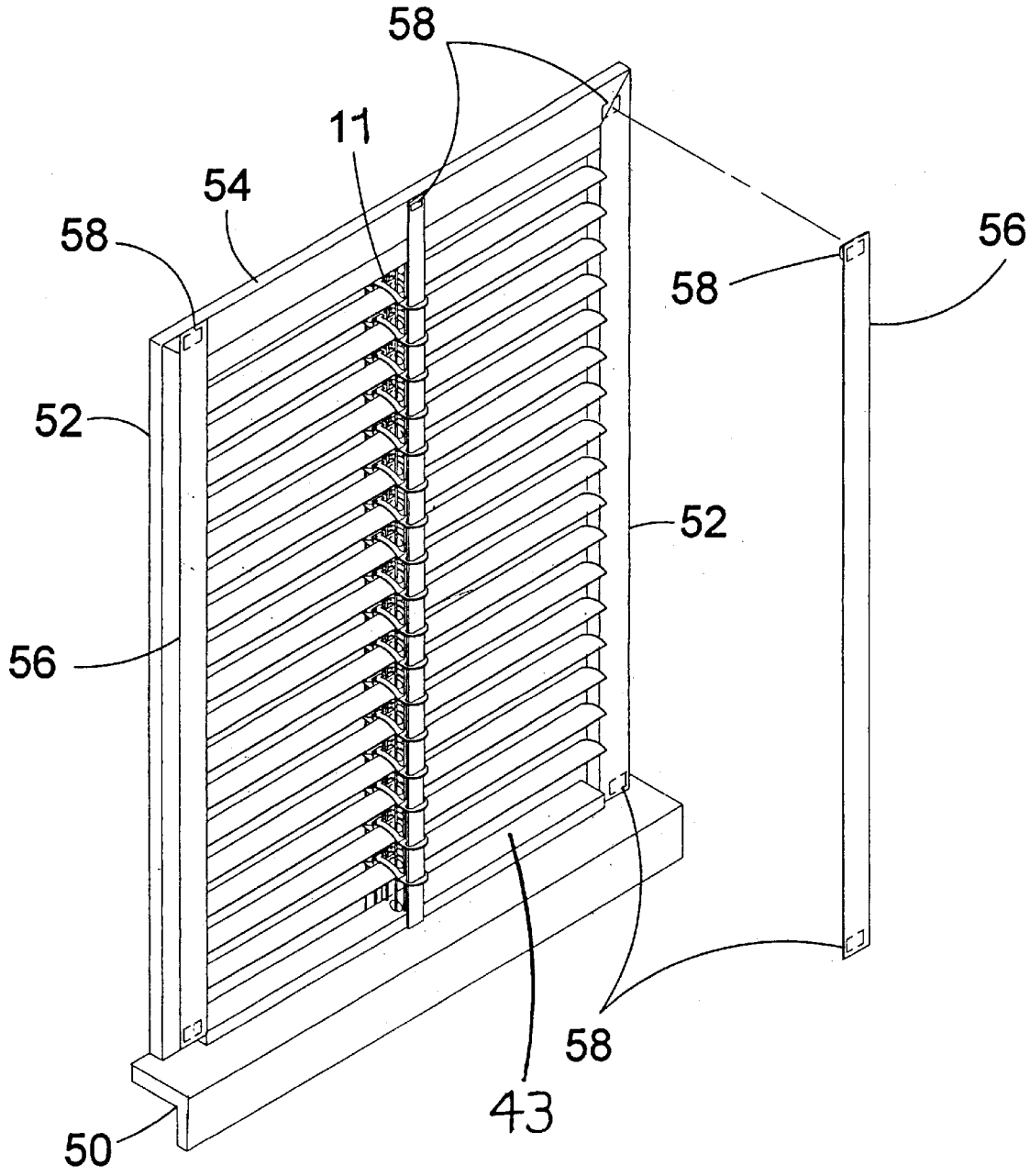

FIG. 5 is a perspective view of an installation of the complementary edge cover strips (56) along the sides of a window casing (52) in which a horizontal window blind (41) has been installed. Points at which the edge cover strips (56) are attached are shown, with one strip (56) being removed a short distance from the window casing (52) for clarity. When used in combination with the clip-positioned slat cover strip (40) in the central areas, the peeping Tom's (100) view has been completely blocked.

Figure 6:
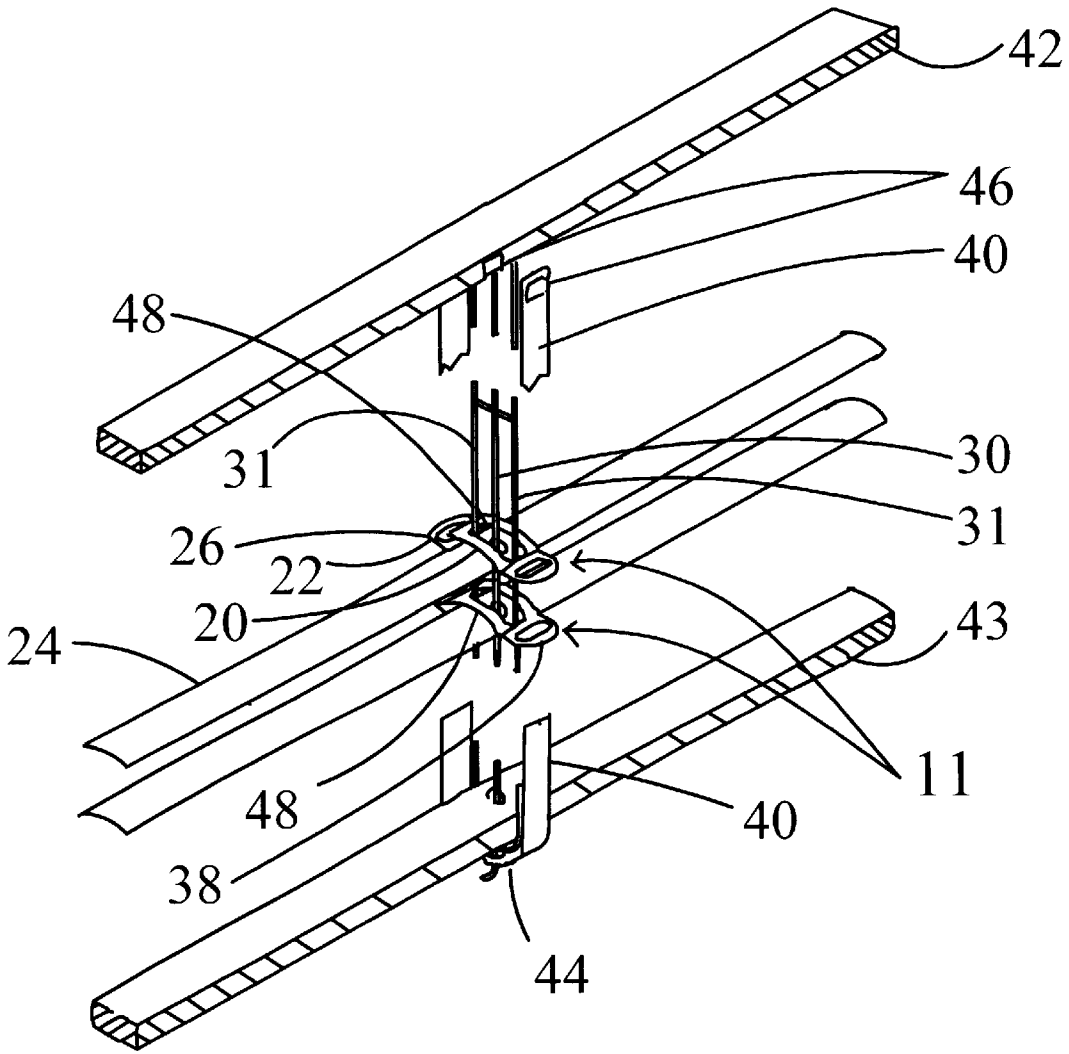

FIG. 6 is a partial perspective view of an installation depicting the attachment points of the slat cover strip (40) after it has been threaded into the loops (38, 26) on the representative clips (11) shown. The slat cover strip (40) is affixed to the top of the window blind (42), threaded through the front loops (38), looped around the bottom of the window blind (43) where it is adapted to allow passage of the control cord (30), threaded through the rear loops (26), and affixed again to the top of the window blind (42). This allows full use and uninterrupted operation of all features of the window blind (41), while simultaneously positioning the slat cover strip (40) to be moved proximate the vertical control cord holes (30) when the window blind (41) is closed.

DESCRIPTION OF THE REFERENCED NUMERALS

Turning now descriptively to the drawings, in which similar reference characters denote similar elements throughout the several views, the FIGURES illustrate the peeping Tom deterrent device for horizontal window blinds of the present invention. With regard to the reference numerals used, the following numbering is used throughout the various drawing figures.

10 peeping Tom deterrent device for horizontal window blinds of the present invention
11 clip
20 device first portion
22 device second portion
24 window blind slat
26 rear loop
28 second portion slot
29 second portion center hole
30 window blind vertical control cords
31 window blind horizontal control cords
32 first portion slot
33 first portion center hole
34 snap tab protrusions
36 snap tab holes
38 front loop
40 slat cover strip
41 horizontal window blind
42 window blind top board
43 window blind bottom board
44 slat cover strip cord hole
46 hook and loop fasteners
48 slat control cord hole
50 window casing bottom
52 window casing side
54 window casing top
56 edge cover strip
58 hook and loop fasteners
100 peeping Tom

DETAILED DESCRIPTION OF THE PREFERRED EMBODIMENT

Turning now descriptively to the drawings, in which similar reference characters denote similar elements throughout the several view, FIGS. 1 through 6 illustrate the peeping Tom deterrent device for horizontal window blinds of the present invention, indicated generally by the numeral (10).

The device (10) is shown in FIG. 1 along with the problem element, a peeping Tom (100).

The device (10) is shown in FIG. 2. The device (10) has a detachably fastened device first portion (20) and device second portion (22). The device first portion (20) is concave for substantial correspondence to the shape of the window blind slat (24). Attached at the end of the device second portion (22) is a rear loop (26). A second portion slot (28) allows passage of the window blind vertical control cords (30) into the rear loop (26). The second portion slot (28) continues through the device second portion (22) to a point near the joinder of the device first portion (20) and the device second portion (22). A corresponding first portion slot (32) is present on the device first portion (20).

When attached, the device first portion (20) and device second portion (22) can be positioned to closely receive the window blind slat (24), as shown in FIG. 4. During device insertion around the window blind slat (24), the vertical control cords (30) remain straight, without binding or realignment, as they pass through the slots (32, 28). Once the window blind slat (24) has been positioned within the first and second portions (20,22) such portions (20,22) are joined. In this embodiment, two snap tab protrusions (34) on the second portion (22) are squeezed into two corresponding snap tab holes (36) on the first portion (20). This joinder fastens the device (10) about the window blind slat (24) until the owner chooses to remove the device (10) by pulling the snap tab protrusions (34) out of snap tab holes (36). In this embodiment the clip is made of plastic, although other types of materials, such as various woods and metals, can also be used, in accordance with the present invention, and as determined by the intended end use for the overall device, as will occur to those of skill in the art upon review of the present disclosure.

The device is particularly suited for mini-blinds with aluminum window blind slats, although other types of blinds, such as Venetian blinds and wood blinds, can also be used, in accordance with the present invention, and as determined by the intended end use for the overall device, as will occur to those of skill in the art upon review of the present disclosure.

A front loop (38) is attached to the first and second portions (20,22) in FIG. 2. The front loop (38) is sized to receive a slat vision block member such as the slat cover strip (40) depicted in FIG. 6. In this embodiment, the slat cover strip (40) is made of vinyl, although other foldable materials, such as nylon and cloth, can also be used, in accordance with the present invention, and as determined by the intended end use for the overall device, as will occur to those of skill in the art upon review of the present disclosure.

Once the owner has joined the desired number of the devices (10) to the window blind slats (24) in FIG. 6, the slat cover strip (40) is attached to the blind top board (42), threaded through the aligned front loops (38) of such devices (10), looped around the window blind bottom board (43), threaded through the aligned rear loops (26), and again attached to the window blind top board (42). In this embodiment, the slat cover strip (40) has a hole (44) through which a window blind vertical control cord (30) passes at the blind bottom board (43). Typical hook and loop fasteners (46) are utilized in this embodiment to attach the slat cover strip (40), to the blind top board (42).

When the slat cover strip (40) has been so attached as in FIG. 3, the slats (24) can be tilt closed and the slat cover strip (40) will be adjacent the slat control cord holes (48), thus blocking the gaze of a peeping Tom (200) through such holes (48).

A plurality of slat vision block members (40) and positioners (10) are required for wide blinds with more than one column of control cord holes (48) per window blind slat (24). This configuration is not depicted in the drawings, but, is readily extended from FIG. 3.

In some window blind installations as in FIG. 5, the window blind slats (24) are recessed within a window casing bottom (50), window casing sides (52), and a window casing top (54), as opposed to other installations where the window blind slats (24) extend beyond the window casing sides (52). When recessed, a possible view exists between the end of the window blind slats (24) and the window casing side (52). Complimentary edge vision block members, such as edge cover strips (56) are provided which have sufficient width to block this view. Typical hook and loop fasteners (58) are provided to attach the edge cover strips (56) to the window casing bottom (50), sides (52), or top (54), as necessary to properly position the edge cover strips (56), such that the edge gap view is blocked and the normal operation of raising and lowering blinds is not impeded and the normal operation of tilt opening and tilt closing blinds is not impeded. This position will typically involve the edge cover strip (56) extending, in part, beyond the inside edge of the window casing side (52).

Additional Embodiments

In another embodiment (not shown in FIGS), the front loop is omitted from the device and the strip is threaded on one side of the window blinds only.

Alternative Embodiments

It will be understood that each of the elements described above, or two or more together may also find a useful application in other types of devices differing from the type described above.

Conclusion, Ramifications, and Scope

Although the description above contains many specifications, these should not be construed as limiting the scope of the invention but as merely providing illustrations of some of the presently preferred embodiments of this invention. For example, the clips can be made of different materials such as metal, plastic, or aluminum. The clips can be of different shapes or sizes. The clips can have different types of closure mechanisms. The slat cover strips and edge cover strips can be of different materials such as vinyl, cloth, nylon, or plastic. The slat cover strips and edge cover strips can be of different colors to match the room interior. The slat cover strips and edge cover strips can be of different patterns if desired such as animated cartoon characters as a designer item for children's bedrooms. The slat cover stips and edge cover strips can be of different widths.

Without further analysis, the foregoing description will so fully reveal the mechanism of the present invention that others of average skill in the prior art can adapt it for different applications meeting the claims of said invention.

I claim:

1. In window blinds of the type having slats, control cords, and one or more control cord holes in the slats, the improvement, which comprises:

a) a slat vision block member, the slat vision block member having a width greater than the width of the cord holes in the slats, the slat vision block member being foldable such that it folds when the blinds are raised;

b) a clip, the clip having:

1) a first portion and a second portion, the first and second portions each having a first and second end, the first and second portion first ends being joined, the first and second portion second ends being detachably fastenable about one of the slats, the second portion second end further having a rear loop, the rear loop being sized to receive the slat vision block member, the first and second portion each further having a slot beginning at the second ends of the first and second portions, the slot being sized to allow passage of the cords; and 2) a front loop, the front loop being attached proximate a joinder thereof of the first and second portion first ends, the front loop being shaped to receive the slat vision block member such that, when the slat vision block member is threaded into the front and rear loops, and the blinds closed, the slat vision block member is positioned proximate the control cord hole in the slat about which the clip is fastened, with the loops on said clip having means to hold said slat vision block member proximate the control cord hole.

2. The improvement of claim 1, wherein the slat vision block member is attached proximate the top of the window blinds, is threaded through one or more of the clips' front loops, is looped around the bottom of the window blinds, is threaded through one or more of the clips' rear loops, and is again attached proximate the top of the window blinds.

3. The improvement of claim 2 wherein the slat vision block member is further affixed to the window blind's bottom.

4. The improvement of claim 1, wherein the slats are concave and the clip first portion is shaped to correspond with the slat concavity.

5. The improvement of claim 1, wherein a plurality of the clips are fastened to a plurality of the slats, the clips being more or less vertically aligned.

6. The improvement of claim 1, wherein the front loop is shaped to retain the slat vision block member in an untwisted and untangled position.

7. The improvement of claim 1, wherein the rear loop is shaped to retain the slat vision block member in an untwisted and untangled position.

8. The improvement of claim 1, wherein the window blind slats have left and right ends and the window blinds are positioned within a window casing having a top, bottom, left side and right side, such that a left and right gap is created between the window blind slats' left and right ends and the window casing left and right sides, respectively, the improvement further comprising a pair of complementary edge vision block members, the complementary edge vision block members being of sufficient width that, when attached proximate the window casing left side and right side, the left gap and the right gap are covered.

9. In window blinds of the type having slats, control cords, and one or more control cord holes in the slats, the improvement, which comprises:

a) a slat vision block member, the slat vision block member having a width greater than the width of the cord holes in the slats, the slat vision block member being foldable such that it folds when the blinds are raised;

b) a clip, the clip having:

a first portion and a second portion, the first and second portions each having a first and second end, the first and second portion first ends being joined, the first and second portion second ends being detachably fastenable about one of the slats, the second portion second end further having a rear loop, the rear loop being sized to receive the vision block member, the first and second portion each further having a slot beginning at the second ends of the first and second portions, the slot being sized to allow passage of the cords, with the loop on said clip having means to hold said slat vision block member proximate the control cord hole.

10. The device of claim 9, wherein the clip first portion is concave in shape to correspond with the slat concavity.

11. The device of claim 9, wherein a plurality of the clips are fastened to a plurality of the slats, the clips being more or less vertically aligned.

12. The device of claim 9, wherein the rear loop is shaped to retain the slat vision block member in an untwisted and untangled position.

13. The device of claim 9, wherein the slat vision block member is attached proximate the top of the window blinds, is threaded through one or more of the clips' rear loops, is looped around the bottom of the window blinds, and is attached proximate the bottom of the window blinds.

14. The device of claim 9, wherein the window blind slats have left and right ends and the window blinds are positioned within a window casing having a top, bottom, left side and right side, such that a left and right gap is created between the window blind slats' left and right ends and the window casing left and right sides, respectively, the improvement further comprising a pair of complementary edge vision block members, the complementary edge vision block members being of sufficient width that, when attached proximate the window casing left side and right side, the left gap and the right gap are covered.

15. In window blinds of the type having slats, control cords, and one or more control cord holes in the slats, the improvement, which comprises:

a) a slat vision block member, the slat vision block member having a width greater than the width of the cord holes in the slats, the slat vision block member being foldable such that it folds when the blinds are raised;

b) a clip, the clip having:

1) a first portion and a second portion, the first and second portions each having a first and second end, the first and second portion first ends being joined, the first and second portion second ends being detachably fastenable about one of the slats, the first and second portions each further having a slot beginning at the second ends of the first and second portions, the slot being sized to allow passage of the cords; and 2) a front loop, the front loop being attached proximate a joinder thereof of the first and second portion first ends, the front loop being shaped to receive the slat vision block member such that, when the slat vision block member is threaded into the front and rear loops, and the blinds closed, the slat vision block member is positioned proximate the control cord hole in the slat about which the clip is fastened, with the loop on said clip having means to hold said slat vision block member proximate the control cord hole.

16. The device of claim 15, wherein the clip first portion is concave in shape to correspond with the slat concavity.

17. The device of claim 15, wherein a plurality of the clips are fastened to a plurality of the slats, the clips being more or less vertically aligned.

18. The device of claim 15, wherein the front loop is shaped to retain the slat vision block member in an untwisted and untangled position.

19. The device of claim 15, wherein the slat vision block member is attached proximate the top of the window blinds, is threaded through one or more of the clips' front loops, and is attached proximate the bottom of the window blinds.

20. The device of claim 15, wherein the window blind slats have left and right ends and the window blinds are positioned within a window casing having a top, bottom, left side and right side, such that a left and right gap is created between the window blind slats' left and right ends and the window casing left and right sides, respectively, the improvement further comprising a pair of complementary edge vision block members, the complementary edge vision block members being of sufficient width that, when attached proximate the window casing left side and right side, the left gap and the right gap are covered.

* * * * *